US008197360B2

(12) United States Patent
Ricci et al.

(10) Patent No.: US 8,197,360 B2
(45) Date of Patent: Jun. 12, 2012

(54) MULTI-LAYERED GOLF BALLS CONTAINING POLYETHYLENE POWDER

(75) Inventors: Shawn Ricci, New Bedford, MA (US); Michael Michalewich, Mansfield, MA (US); Mark L. Binette, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 486 days.

(21) Appl. No.: 12/432,424

(22) Filed: Apr. 29, 2009

(65) Prior Publication Data

US 2010/0279797 A1 Nov. 4, 2010

(51) Int. Cl.
*A63B 37/06* (2006.01)

(52) U.S. Cl. ..... 473/373

(58) Field of Classification Search ..... 473/373, 473/374

See application file for complete search history.

(56) References Cited

U.S. PATENT DOCUMENTS

| | | | | |
|---|---|---|---|---|
| 3,478,132 | A | 11/1969 | Randolph | |
| 4,085,937 | A | 4/1978 | Schenk | |
| 4,264,075 | A | 4/1981 | Miller et al. | |
| 4,688,801 | A | 8/1987 | Reiter | |
| 6,612,939 | B1 | 9/2003 | Sullivan et al. | |
| 6,884,182 | B2 | 4/2005 | Nardacci | |
| 6,964,621 | B2 | 11/2005 | Bulpett et al. | |
| 7,202,303 | B2 | 4/2007 | Wu et al. | |
| 2007/0197724 | A1 * | 8/2007 | Wu et al. | 525/92 F |

OTHER PUBLICATIONS

Product Information Sheet, "GUR PE-UHMW—GUR Products as Rubber Additives," Ticona Polymers, Oct. 2001.
Product Information Sheet, "GUR UHMW-PE" Ticona Polymers, Sep. 2007.

* cited by examiner

*Primary Examiner* — Raeann Gorden
(74) *Attorney, Agent, or Firm* — Daniel W. Sullivan

(57) ABSTRACT

A multi-layered golf ball having an inner core, at least one intermediate layer, and outer cover is provided. The intermediate layer is made from a polyurea composition containing ultra-high molecular weight polyethylene powder particulate dispersed therein. The intermediate layer provides the ball with advantageous properties including improved durability, toughness, hardness, and impact-resistance.

12 Claims, 3 Drawing Sheets

MULTI-LAYERED GOLF BALLS CONTAINING POLYETHYLENE POWDER

BACKGROUND OF THE INVENTION

1. Field of the Invention

The present invention relates generally to a multi-layered golf ball having an inner core, at least one intermediate layer, and an outer cover, wherein the intermediate layer is made from a polyurea composition. More particularly, the polyurea composition contains ultra-high molecular weight polyethylene (UHMWPE) powder particulate dispersed therein.

2. Brief Review of the Related Art

In recent years, golf balls having a multi-layered design have become more common. For example, three-piece balls having an inner core, at least one intermediate layer surrounding the core, and an outer cover have been developed. Different materials are used to make each of these layers in effort to impart more desirable playing performance properties to the golf ball. Referring to FIG. 1, a golf ball (10) having a conventional three-piece design is shown. The ball (10) includes an inner core (12) that may be, for example, solid, semi-solid, fluid-filled, or hollow. A variety of materials may be used to make the core, particularly natural and synthetic rubbers such as styrene butadiene, polybutadiene, isoprene, polyisoprene, and trans-isoprene. In one version, as shown in FIG. 1, the core (12) is a single-piece made from a natural or synthetic rubber composition such as polybutadiene. In other instances, as shown in FIG. 2, the golf ball (10*a*) contains a two-piece core; that is, there are two core pieces (12*a*, 14). For example, an inner core portion (12*a*) may be made of a first base rubber material and an outer core layer (14), which surrounds the inner core (12*a*), may be made of a second base rubber material. Cross-linking agents and fillers may be added to the rubber materials. The respective core portions (12*a*, 14) may be made of the same or different rubber materials. The multi-layered core (constituting inner and outer core layers (12*a*, 14)) may be referred to as the "center" of the ball.

In FIGS. 1 and 2, each respective ball (10, 10*a*) is shown having an intermediate layer (16, 16*a*). As used herein, the term, "intermediate layer" means a layer of the ball disposed between the core and cover. The intermediate layer may be considered an outer core layer or inner cover layer or any other layer disposed between the inner core and outer cover of the ball. The intermediate layer also may be referred to as a casing or mantle layer. It further should be understood that the ball may include one or more intermediate layers. In conventional golf balls (10, 10*a*), the intermediate layer (16, 16*a*) may be made of ionomer resins. These cross-linked polymers contain inter-chain ionic bonding as well as covalent bonding. The ionomer resins include, for example, a copolymer of ethylene and a vinyl comonomer with an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn® (DuPont) and Escor®D and Iotek® (Exxon). These ionomer resins are available in various grades and are identified based on the type of base resin, molecular weight, type of metal ion, amount of acid, degree of neutralization, additives, and other properties.

Lastly, each of the conventional balls (10, 10*a*) shown in FIGS. 1 and 2 includes an outer cover layer (18, 18*a*) designed to have high durability, abrasion-resistance, impact-resistance, resiliency, and other desirable properties. The golf balls (10, 10*a*) can comprise one or more cover layers (18, 18*a*). Different materials may be used to make the cover layer (18, 18*a*) including the above-described ionomer resins. The covers (18, 18*a*) provide the balls with desirable durability and rebounding properties. The rebound performance of the golf ball is based on initial velocity of the ball after being struck by a golf club and its outgoing velocity after making impact with a hard surface. In general, golf balls having a harder outer cover tend to have higher rebound performance. Other materials can be used to make the cover including, for example, polyurethane, polyurea, and polyurethane/polyurea hybrid compositions. These polyurethane and/or polyurea compositions can be used to help provide the player with a better "feel" when he/she strikes the ball with the club face. Players may hear a pleasant "clicking" sound as the club face makes impact with the outer cover of these balls. In addition, the softer feel of the ball cover allows players to place a spin on the ball and better control its flight direction.

As discussed above, polyurethane and polyurea compositions provide the ball with desirable softness and improved playing performance properties. Golf players may experience a better sensation when striking a golf ball having a cover made of polyurethane and polyurea compositions. Because of these advantageous properties, it has been proposed in certain instances that polyurethane and polyurea materials be used to make intermediate casing or mantle layers that surround the golf ball core as well as the outer cover layer.

For example, Wu et al., U.S. Pat. No. 7,202,303 discloses a golf ball including a cover, core, and at least one intermediate layer interposed between the cover and core. The compositions used for the different layers can be polyurethane-based compositions incorporating block copolymers, polyurea-based compositions incorporating block copolymers, and mixtures thereof. The compositions may be formed by reacting excess prepolymer, which is based on an isocyanate and a polyol or amine, with a functionalized block copolymer to form an intermediate prepolymer having the block copolymer portion capped with isocyanate groups at each end. This prepolymer is then reacted with a curing agent to form a polyurethane-based or polyurea-based composition.

Bulpett et al., U.S. Pat. No. 6,964,621 discloses a multi-layered golf ball having an inner core, at least one intermediate layer, and an outer cover, wherein the cover is made from a polyurea composition, preferably saturated and/or water resistant. The polyurea composition is made from a polyurea prepolymer and curing agent, wherein the polyurea prepolymer includes an isocyanate and amine-terminated compound. The '621 patent also discloses that the polyurea composition may be used to form the intermediate layer.

Nardacci, U.S. Pat. No. 6,884,182 discloses a golf ball comprising: a core; a cover; and at least one intermediate layer disposed between the cover and core. The intermediate layer is formed of a composite of binding material and interstitial fiber material. The interstitial fiber material is radially oriented in the intermediate layer and symmetrically distributed. Preferably, the fiber material is oriented so that a central axis of the fiber material is co-axial with a radius line of the ball. Preferably, the fiber material is positioned such that it has spherical symmetry with the ball. In one embodiment, the fiber material may extend from the intermediate layer into the core.

Sullivan et al., U.S. Pat. No. 6,612,939 discloses golf balls having an outermost polymeric cover; one or more mantle layers; and an inner core material. The mantle layer(s) may be formed of metal, ceramic, or composite materials. The metals used in the mantle layer are preferably steel, titanium, chromium, nickel, or alloys thereof. If ceramic layers are desired, they can be made of such materials as silica, soda lime, lead silicate, borosilicate, aluminoborosilicate, aluminosilicate, and various glasses. The ceramics can be reinforced with silicon carbide, glass and/or carbon fibers. A composite mantle layer also can be prepared from a composite material of glass fibers dispersed within a thermoset matrix such as a polyimide material, silicone, vinyl ester, polyester, or melamine. In other embodiments, glass or carbon fibers may be dispersed within a nylon matrix. The golf balls, according to the '939 patent, show improved spin, feel, and acoustic properties.

However, one problem with using conventional polyurea compositions in intermediate casing layers is the finished layer may show poor impact-resistance. Particularly, this may be a problem when golf ball manufacturers try to increase the hardness of a casing layer made with a polyurea composition in order to make it comparable to the hardness of a casing layer made with ionomer resin. That is, the polyurea composition may be formulated to have increased hardness but this may be offset by the polyurea formulation showing decreased impact-resistance. The resulting golf ball may have desirable hardness properties but appear damaged and worn after only limited use, because of its low impact-resistance.

Thus, it would be desirable to develop a golf ball containing an intermediate casing layer made of a polyurea composition having sufficient hardness and impact-resistance. The improved casing layer would provide the ball with a combination of good durability and toughness as well as optimum playing performance properties such as feel, softness, spin control, and the like. The present invention provides golf balls having such intermediate casing layers.

SUMMARY OF THE INVENTION

The present invention generally relates to a multi-layered golf ball having an inner core, at least one intermediate layer, and an outer cover. The intermediate layer is made from a polyurea composition containing ultra-high molecular weight polyethylene (UHMWPE) powder particulate dispersed therein. The intermediate layer provides the ball with advantageous properties including improved durability, toughness, hardness, and impact-resistance. The core may be made of a natural or synthetic rubber material such as polybutadiene. The core may have a single-piece or multi-piece structure. The cover material overlying the intermediate layer may be made of various materials such as, for example, ionomer resins, polyurethanes, and polyureas.

The polyurea composition used in the intermediate layer is preferably made using a prepolymer method. This involves a first reaction between the isocyanate and amine-terminated compound to produce a polyurea prepolymer, and a subsequent reaction between the prepolymer and an amine-terminated curing agent. The UHMWPE powder is added to the polyurea composition to improve the impact-resistance of the resulting golf ball. The intermediate layer of the multi-layered golf ball includes a substantially continuous polymeric phase (matrix) comprising the polyurea material and a substantially disperse phase of UHMWPE powder particulate. The particles are dispersed substantially throughout the polymeric matrix.

The golf ball core may have a diameter in the range of about 1.26 to about 1.60 inches. The range of thicknesses for the intermediate layer(s) may vary but is generally about 0.015 to about 0.120 inches. The thickness of the cover may vary, but it is generally in the range of about 0.020 to about 0.090 inches and preferably about 0.050 inches or less. The components making up the golf ball may have different hardness values. For example, the hardness of the core may be in the range of about 30 to about 65 Shore D and more preferably in the range of about 35 to about 60 Shore D. The material hardness of the composition making up the intermediate layer may be about 30 to about 75 Shore D and more preferably in the range of about 55 to about 70 Shore D. The material hardness of the composition constituting the cover may be is preferably in the range of about 30 to about 70 Shore D.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE PREFERRED EMBODIMENTS

Figure 1:
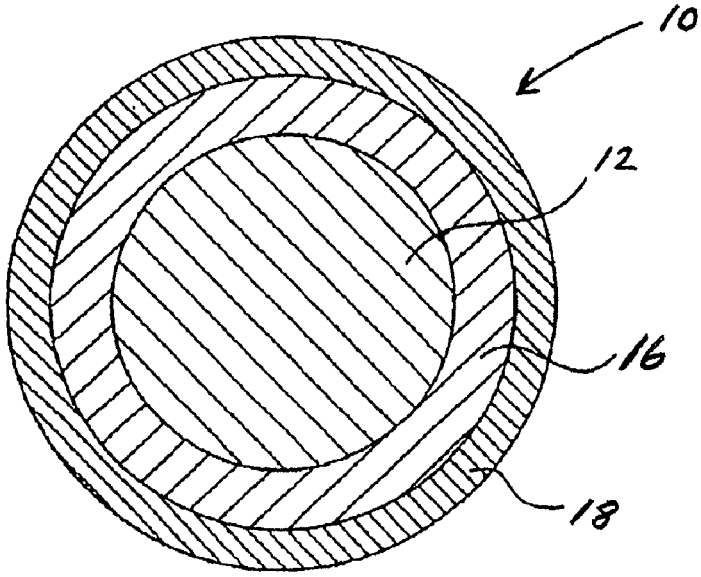
FIG. 1 (PRIOR ART)
FIG. 1 is a cross-sectional view of a prior art, multi-layered golf ball having a one-piece core.
Figure 2:
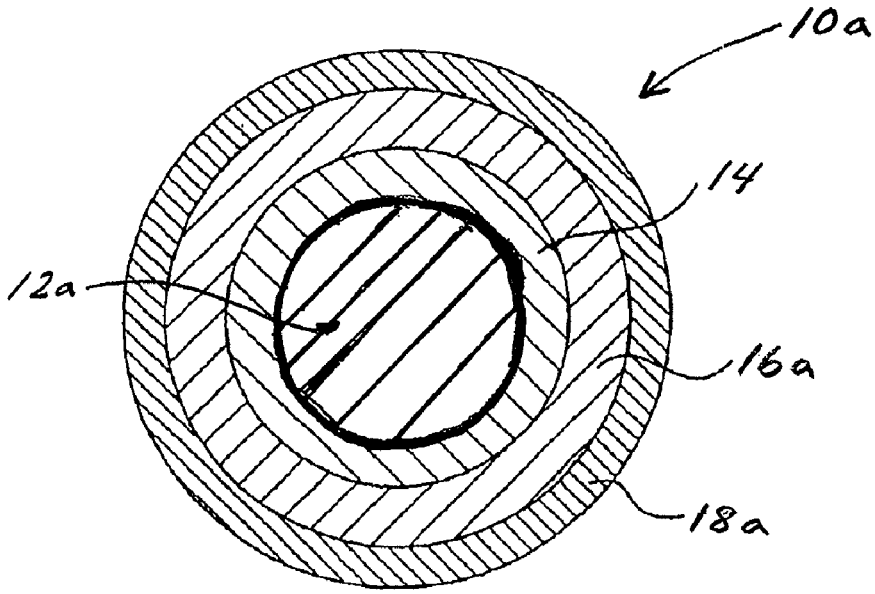
FIG. 2 (PRIOR ART)
FIG. 2 is a cross-sectional view of a prior art, multi-layered golf ball having a two piece core.
Figure 3:
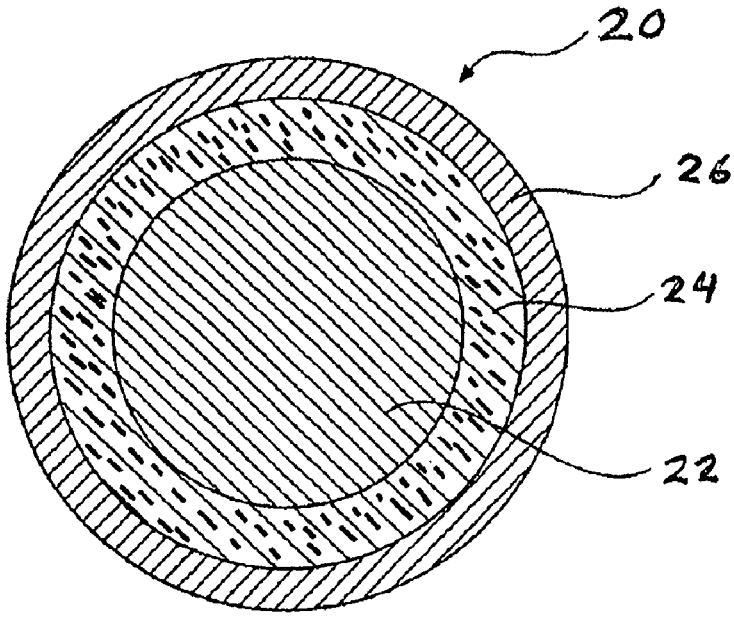
FIG. 3 is a cross-sectional view of a multi-layered golf ball having a one-piece core made in accordance with the present invention.

The present invention relates to multi-layered golf balls having at least one core layer, intermediate (casing layer), and cover layer. Referring to FIG. 3, a golf ball (20) having a single-piece core (22), which can be made in accordance with this invention, is shown. The golf ball (20) has a solid core (22), intermediate layer (24) made of polyurea composition containing ultra-high molecular weight polyethylene (UHMWPE) powder, and a cover layer (26). The composition of the core (22), intermediate layer (24), and cover layer (26) are described in further detail below.

Composition of Core

Figure 4:
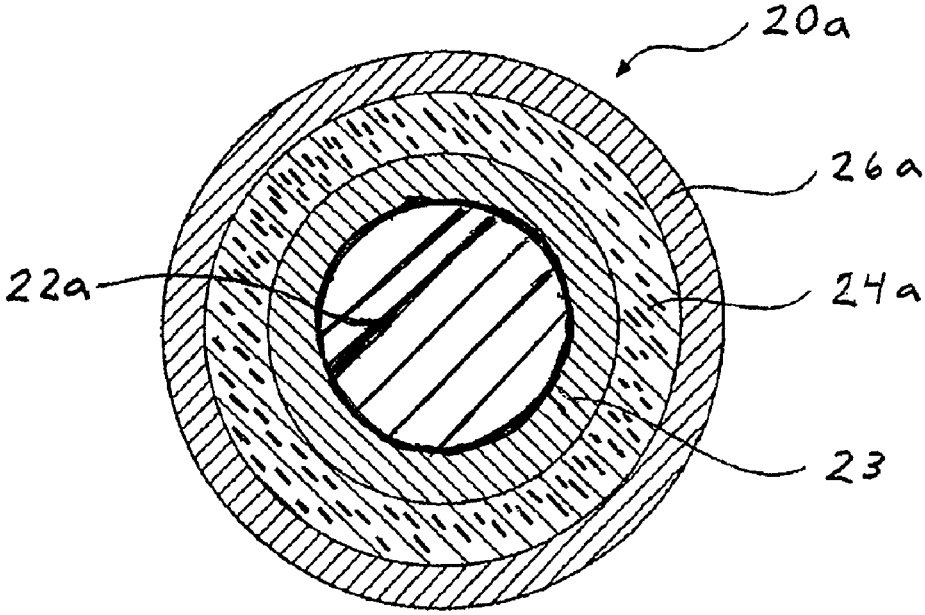
FIG. 4 is a cross-sectional view of a multi-layered golf ball having a two-piece core made in accordance with the present invention.

The core of the golf ball may be solid, semi-solid, fluid-filled, or hollow, and the core may have a single-piece or multi-piece structure. A variety of materials may be used to make the core including thermoset compositions such as rubber, styrene butadiene, polybutadiene, isoprene, polyisoprene, trans-isoprene; thermoplastics such as ionomer resins, polyamides or polyesters; and thermoplastic and thermoset polyurethane and polyurea elastomers. In one embodiment, as shown in FIG. 3, the core (22) is a single-piece structure made from a natural or synthetic rubber composition such as polybutadiene. In other instances, a two-piece core is constructed; that is, there are two core portions or layers. In FIG. 4, a golf ball (20*a*) having a two-piece solid core (22*a*, 23), intermediate layer (24*a*), and a cover layer (26*a*), which can be made in accordance with this invention, is shown. The intermediate layer (24*a*) is made of a polyurea composition containing ultra-high molecular weight polyethylene (UHMWPE) powder. The inner core portion (22*a*) may be made of a first base rubber material and the outer core layer (23), which surrounds the inner core (22*a*), may be made of a second base rubber material. The respective core pieces (22*a*, 23) may be made of the same or different rubber materials as described above. Cross-linking agents and fillers may be added to the rubber materials.

More particularly, materials for solid cores typically include compositions having a base rubber, filler, initiator agent, and cross-linking agent. The base rubber typically includes natural or synthetic rubber, such as polybutadiene rubber. In one embodiment, the base rubber is 1,4-polybutadiene having a cis-structure of at least 40%. The polybutadiene can be blended with other elastomers such as natural rubber, polyisoprene rubber, styrene-butadiene rubber and/or other polybutadienes. Another suitable rubber that may be used in the core is trans-polybutadiene. This polybutadiene isomer is formed by converting the cis-isomer of the polybutadiene to the trans-isomer during a molding cycle. A soft and fast agent such as pentachlorothiophenol (PCTP) or ZnPCTP can be blended with the polybutadiene. These compounds may also function as cis-to-trans catalyst to convert some cis-1,4 bonds in the polybutadiene into trans 1,4 bonds.

Fillers, which may be used to modify such properties as the specific gravity (density-modifying materials), hardness, weight, modulus, resiliency, compression, and the like may be added to the core composition. Normally, the fillers are inorganic, and suitable fillers include numerous metals or metal oxides, such as zinc oxide and tin oxide, as well as barium sulfate, zinc sulfate, calcium carbonate, barium carbonate, clay, tungsten, tungsten carbide, silica, and mixtures thereof. Fillers may also include various foaming agents or blowing agents, zinc carbonate, regrind (recycled core material), and the like. In addition, polymeric, ceramic, metal, and glass microspheres may be used.

Golf balls made in accordance with this invention can be of any size, although the USGA requires that golf ball used in competition have a diameter of at least 1.68 inches and a weight of no greater than 1.62 ounces. For play outside of USGA competition, the golf balls can have smaller diameters and be heavier. In one embodiment, the core is a single-piece core having an outside diameter of about 1.26 to about 1.60 inches. Preferably, the single-piece core has a diameter of about 1.57 inches. The core generally makes up a substantial portion of the ball, for example, the core may constitute at least about 95% of the ball. The hardness of the core may vary depending upon the desired properties of the ball. In general, core hardness is in the range of about 30 to about 65 Shore D and more preferably in the range of about 35 to about 60 Shore D. The compression of the core portion is generally in the range of about 70 to about 110 and more preferably in the range of about 80 to about 100.

Composition of Cover Material

The cover material of the golf ball may be constructed using a variety of materials. The cover material should impart durability, toughness and tear-resistance to the ball. As discussed above, suitable cover materials include, but are not limited to, ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyurethanes; polyureas; copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; cross-linked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof. In a particular embodiment, the cover is a single layer formed from a composition selected from the group consisting of ionomers, polyester elastomers, polyamide elastomers, and combinations of two or more thereof.

The golf ball of this invention may have single-, dual-, or multi-layered covers preferably having an overall thickness within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.120 inches. In a particular embodiment, the cover is a single layer having a thickness of from 0.025 inches to 0.035 inches. The cover preferably has a surface hardness of 70 Shore D or less, or 65 Shore D or less, or 60 Shore D or less, or 55 Shore D or less. The cover preferably has a material hardness of 65 Shore D or less, or 60 Shore D or less, or 55 Shore D or less.

Composition of Intermediate Layer

The intermediate layer, comprising a polyurea composition, is disposed between the core and cover layer. In general, polyurea compositions contain urea linkages formed by reacting an isocyanate group with an amine group. The chain length of the polyurea is extended by reacting the polymer with an amine-terminated curing agent. When amine-terminated compounds are used as the curing agent, the resulting polymer only contains urea linkages. However, if a hydroxyl-terminated curing agent is used, any excess isocyanate groups in the polymer will react with the hydroxyl groups in the curing agent and create urethane linkages. That is, a polyurea/urethane hybrid composition is produced, which is distinct from a pure polyurea composition.

It also should be recognized that polyurethanes and polyureas are significantly different compositions. Polyurethanes contain urethane linkages that are formed by reacting an isocyanate group (—N═C═O) with a hydroxyl group (OH). Polyurethanes are produced by the reaction of a polyisocyanate with a polyalcohol (polyol) in the presence of a catalyst and other additives. The chain length of the polyurethane is extended by reacting the prepolymer with an amine-terminated curing agent. A polyurethane/urea hybrid blend may be produced by reacting the prepolymer with an amine curing agent.

Any suitable isocyanate known in the art can be used to produce the polyurea compositions in accordance with this invention. Such isocyanates include, for example, aliphatic, cycloaliphatic, aromatic aliphatic, aromatic, any derivatives thereof, and combinations of these compounds having two or more isocyanate ((—N═C═O) groups per molecule. The isocyanates may be organic polyisocyanate-terminated prepolymers, low free isocyanate prepolymers, and mixtures thereof. The isocyanate-containing reactable component may also include any isocyanate-functional monomer, dimer, trimer, or polymeric adduct thereof, prepolymer, quasi-prepolymer, or mixtures thereof. Isocyanate-functional compounds may include monoisocyanates or polyisocyanates that include any isocyanate functionality of two or more.

Preferred isocyanates include diisocyanates (having two NCO groups per molecule), biurets thereof, dimerized uretdiones thereof, trimerized isocyanurates thereof, and polyfunctional isocyanates such as monomeric triisocyanates. Diisocyanates typically have the generic structure of OCN—R—NCO. Exemplary diisocyanates include, but are not limited to, unsaturated isocyanates such as: p-phenylene diisocyanate ("PPDI," i.e., 1,4-phenylene diisocyanate), m-phenylene diisocyanate ("MPDI," i.e., 1,3-phenylene diisocyanate), o-phenylene diisocyanate (i.e., 1,2-phenylene diisocyanate), 4-chloro-1,3-phenylene diisocyanate, toluene diisocyanate ("TDI"), m-tetramethylxylene diisocyanate ("m-TMXDI"), p-tetramethylxylene diisocyanate ("p-TMXDI"), 1,2-, 1,3-, and 1,4-xylene diisocyanates, 2,2'-, 2,4'-, and 4,4'-biphenylene diisocyanates, 3,3'-dimethyl-4,4'-biphenylene diisocyanate ("TODI"), 2,2'-, 2,4'-, and 4,4'-diphenylmethane diisocyanates ("MDI"), 3,3'-dimethyl-4,4'-diphenylmethane diisocyanate, carbodiimide-modified MDI, polyphenylene polymethylene polyisocyanate ("PMDI," i.e., polymeric MDI), 1,5-naphthalene diisocyanate ("NDI"), 1,5-tetrahydronaphthalene diisocyanate, anthracene diisocyanate, tetracene diisocyanate; and saturated isocyanates such as: 1,4-tetramethylene diisocyanate, 1,5-pentamethylene diisocyanate, 2-methyl-1,5-pentamethylene diisocyanate, 1,6-hexamethylene diisocyanate ("HDI") and isomers thereof, 2,2,4- and 2,4,4-trimethylhexamethylene diisocyanates, 1,7-heptamethylene diisocyanate and isomers thereof, 1,8-octamethylene diisocyanate and isomers thereof, 1,9-novamethylene diisocyanate and isomers thereof, 1,10-decamethylene diisocyanate and isomers thereof, 1,12-dodecane diisocyanate and isomer thereof, 1,3-cyclobutane diisocyanate, 1,2-, 1,3-, and 1,4-cyclohexane diisocyanates, 2,4- and 2,6-methylcyclohexane diisocyanates ("HTDI"), isophorone diisocyanate ("IPDI"), isocyanatomethylcyclohexane isocyanate, isocyanatoethylcyclohexane isocyanate, bis(isocyanatomethyl)cyclohexane (i.e., 1,4-cyclohexane-bis(methylene isocyanate)), 4,4'-dicyclohexylmethane diisocyanate ("$H_{12}$ MDI," i.e., bis(4-isocyanatocyclohexyl)-methane), 2,4'- and 4,4'-dicyclohexane diisocyanates, 2,4'- and 4,4'-bis(isocyanatomethyl) dicyclohexanes. Dimerized uretdiones of diisocyanates and polyisocyanates include, for example, unsaturated isocyanates such as uretdiones of toluene diisocyanates, uretdiones of diphenylmethane diisocyanates; and saturated isocyanates such as uretdiones of hexamethylene diisocyanates. Trimerized isocyanurates of diisocyanates and polyisocyanates include, for example, unsaturated isocyanates such as trimers of diphenylmethane diisocyanate, trimers of tetramethylxylene diisocyanate, isocyanurates of toluene diisocyanates; and saturated isocyanates such as isocyanurates of isophorone diisocyanate, isocyanurates of hexamethylene diisocyanate, isocyanurates of trimethyl-hexamethylene diisocyanates. Monomeric triisocyanates include, for example, unsaturated isocyanates such as 2,4,4'-diphenylene triisocyanate, 2,4,4'-diphenylmethane triisocyanate, 4,4',4"-triphenylmethane triisocyanate; and saturated isocyanates such as: 1,3,5-cyclohexane triisocyanate. Preferably, the isocyanate is selected from the group consisting of MDI, $H_{12}$MDI, PPDI, TDI, IPDI, HDI, NDI, XDI, TMXDI, THDI, and TMDI, and homopolymers and copolymers and mixtures thereof.

There are two basic techniques that can be used to make the polyurea compositions of this invention: a) one-shot technique, and b) prepolymer technique. In the one-shot technique, the isocyanate, amine-terminated compound, and amine curing agent are reacted in one step. Meanwhile, the prepolymer technique involves a first reaction between the isocyanate and amine-terminated compound to produce a polyurea prepolymer, and a subsequent reaction between the prepolymer and amine curing agent. As a result of the reaction between the isocyanate and amine-terminated compound, there will be some unreacted NCO groups in the polyurea prepolymer. For purposes of the present invention, the prepolymer should have about 2.0 to about 14.0%, and preferably about 8 to about 14%, unreacted NCO groups. As the weight percent of unreacted isocyanate groups increases, the hardness of the composition also generally increases. Either the one-shot or prepolymer method may be employed to produce the polyurea compositions of the invention; however, the prepolymer technique is preferred because it provides better control of the chemical reaction. The prepolymer method provides a more homogeneous mixture resulting in a more consistent polymer composition. The one-shot method results in a mixture that is inhomogeneous (more random) and affords the manufacturer less control over the molecular structure of the resultant composition.

In the casting process, the polyurea composition can be formed by chain-extending the polyurea prepolymer with a single curing agent or a blend of curing agents as described further below. The compositions of the present invention may be selected from among both castable thermoplastic and thermoset materials. Thermoplastic polyurea compositions are typically formed by reacting the isocyanate and amine-terminated compound, each having two (or less) functional groups, at a 1:1 stoichiometric ratio. For example, a prepolymer may be cured with a secondary diamine to make the non-cross-linked thermoplastic composition. Thermoset compositions, on the other hand, are cross-linked polymers and are typically produced from the reaction of an isocyanate and amine-terminated compound, wherein each component has two (or greater) functional groups, at normally a 1.05:1 stoichiometric ratio. For example, a prepolymer may be cured with a primary or secondary diamine to make the cross-linked thermoset polyureas. In general, thermoset polyurea compositions are easier to prepare than thermoplastic polyureas.

In a preferred embodiment, the polymer matrix used to form the intermediate layer contains only urea linkages. An amine-terminated curing agent is used to produce the polyurea matrix. However, it is recognized that a polyurea/urethane hybrid composition may be prepared in accordance with this invention in some instances. Such a hybrid composition could be obtained if the polyurea prepolymer were cured with a hydroxyl-terminated curing agent. Any excess isocyanate in the polyurea prepolymer reacts with the hydroxyl groups in the curing agent and forms urethane linkages. The resulting polyurea/urethane hybrid composition contains both urea and urethane linkages.

Suitable amine-terminated curing agents that can be used in chain-extending the polyurea prepolymer of this invention include, but are not limited to, unsaturated diamines such as 4,4'-diamino-diphenylmethane (i.e., 4,4'-methylene-dianiline or "MDA"), m-phenylenediamine, p-phenylenediamine, 1,2- or 1,4-bis(sec-butylamino)benzene, 3,5-diethyl-(2,4- or 2,6-) toluenediamine or "DETDA", 3,5-dimethylthio-(2,4- or 2,6-)toluenediamine, 3,5-diethylthio-(2,4- or 2,6-)toluenediamine, 3,3'-dimethyl-4,4'-diamino-diphenylmethane, 3,3'-diethyl-5,5'-dimethyl4,4'-diamino-diphenylmethane (i.e., 4,4'-methylene-bis(2-ethyl-6-methyl-benezeneamine)), 3,3'-dichloro-4,4'-diamino-diphenylmethane (i.e., 4,4'-methylene-bis(2-chloroaniline) or "MOCA"), 3,3',5,5'-tetraethyl-4,4'-diamino-diphenylmethane (i.e., 4,4'-methylene-bis(2,6-diethylaniline), 2,2'-dichloro-3,3',5,5'-tetraethyl-4,4'-diamino-diphenylmethane (i.e., 4,4'-methylene-bis(3-chloro-2,6-diethyleneaniline) or "MCDEA"), 3,3'-diethyl-5,5'-dichloro-4,4'-diamino-diphenylmethane, or "MDEA"), 3,3'-dichloro-2,2',6,6'-tetraethyl-4,4'-diamino-diphenylmethane, 3,3'-dichloro-4,4'-diamino-diphenylmethane, 4,4'-methylene-bis(2,3-dichloroaniline) (i.e., 2,2',3,3'-tetrachloro-4,4'-diamino-diphenylmethane or "MDCA"), 4,4'-bis(sec-butylamino)-diphenylmethane, N,N'-dialkylamino-diphenylmethane, trimethyleneglycol-di(p-aminobenzoate), polyethyleneglycol-di(p-aminobenzoate), polytetramethyleneglycol-di(p-aminobenzoate); saturated diamines such as ethylene diamine, 1,3-propylene diamine, 2-methyl-pentamethylene diamine, hexamethylene diamine, 2,2,4- and 2,4,4-trimethyl-1,6-hexane diamine, imino-bis(propylamine), imido-bis(propylamine), methylimino-bis(propylamine) (i.e., N-(3-aminopropyl)-N-methyl-1,3-propanediamine), 1,4-bis(3-aminopropoxy)butane (i.e., 3,3'-[1,4-butanediylbis-(oxy)bis]-1-propanamine), diethyleneglycol-bis(propylamine) (i.e., diethyleneglycol-di(aminopropyl)ether), 4,7,10-trioxatridecane-1,13-diamine, 1-methyl-2,6-diamino-cyclohexane, 1,4-diamino-cyclohexane, poly(oxyethylene-oxypropylene) diamines, 1,3- or 1,4-bis(methylamino)-cyclohexane, isophorone diamine, 1,2- or 1,4-bis(sec-butylamino)-cyclohexane, N,N'-diisopropyl-isophorone diamine, 4,4'-diamino-dicyclohexylmethane, 3,3'-dimethyl-4,4'-diamino-dicyclohexylmethane, 3,3'-dichloro-4,4'-diamino-dicyclohexylmethane, N,N'-dialkylamino-dicyclohexylmethane, polyoxyethylene diamines, 3,3'-diethyl-5,5'-dimethyl-4,4'-diamino-dicyclohexylmethane, polyoxypropylene diamines, 3,3'-diethyl-5,5'-dichloro-4,4'-diamino-dicyclohexylmethane, polytetramethylene ether diamines, 3,3',5,5'-tetraethyl-4,4'-diamino-dicyclohexylmethane (i.e., 4,4'-methylene-bis(2,6-diethylaminocyclohexane)), 3,3'-dichloro-4,4'-diamino-dicyclohexylmethane, 2,2'-dichloro-3,3',5,5'-tetraethyl-4,4'-diamino-dicyclohexylmethane, (ethylene oxide)-capped polyoxypropylene ether diamines, 2,2',3,3'-tetrachloro-4,4'-diamino-dicyclohexylmethane, 4,4'-bis(sec-butylamino)-dicyclohexylmethane; triamines such as diethylene triamine, dipropylene triamine, (propylene oxide)-based triamines (i.e., polyoxypropylene triamines), N-(2-aminoethyl)-1,3-propylenediamine (i.e., $N_3$-amine), trimethylolpropane-based triamines, glycerin-based triamines, (all saturated); tetramines such as N,N'-bis(3-aminopropyl)ethylene diamine (i.e., $N_4$-amine) (both saturated), triethylene tetramine; and other polyamines such as tetraethylene pentamine (also saturated).

As discussed above, in some instances, it may be desirable to form a polyurea/polyurethane hybrid blend. In such circumstances, the curing agent used in the reaction of the polyurea prepolymer may be selected from the group consisting of hydroxy-terminated curing agents and mixtures of amine-terminated and hydroxyl-terminated curing agents.

The hydroxy-terminated curing agents are preferably selected from the group consisting of ethylene glycol; diethylene glycol; polyethylene glycol; propylene glycol; 2-methyl-1,3-propanediol; 2-methyl-1,4-butanediol; monoethanolamine; diethanolamine; triethanolamine; monoisopropanolamine; diisopropanolamine; dipropylene glycol; polypropylene glycol; 1,2-butanediol; 1,3-butanediol; 1,4-butanediol; 2,3-butanediol; 2,3-dimethyl-2,3-butanediol; trimethylolpropane; cyclohexyldimethylol; triisopropanolamine; N,N,N',N'-tetra-(2-hydroxypropyl)-ethylene diamine; diethylene glycol bis-(aminopropyl) ether; 1,5-pentanediol; 1,6-hexanediol; 1,3-bis-(2-hydroxyethoxy) cyclohexane; 1,4-cyclohexyldimethylol; 1,3-bis-[2-(2-hydroxyethoxy) ethoxy]cyclohexane; 1,3-bis-{2-[2-(2-hydroxyethoxy)ethoxy]ethoxy}cyclohexane; trimethylolpropane; polytetramethylene ether glycol, preferably having a molecular weight from about 250 to about 3900; and mixtures thereof.

Additional materials, as known in the art, may be added to the polyurea compositions. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives. For example, wetting additives may be added to more effectively disperse the pigments. Antioxidants, stabilizers, softening agents, plasticizers, including internal and external plasticizers, impact modifiers, foaming agents, density-adjusting fillers, reinforcing materials, and compatibilizers also may be added to the composition in amounts known in the art. Generally, the additives will be present in the composition in an amount between about 1 and about 70 weight percent based on the total weight of the composition depending upon the desired properties.

A catalyst may also be employed to promote the reaction between the prepolymer and the curing agent to make the polyurea composition. Suitable catalysts include, but are not limited to bismuth catalyst; zinc octoate; stannous octoate; tin catalysts such as bis-butyltin dilaurate, bis-butyltin diacetate, stannous octoate; tin (II) chloride, tin (IV) chloride, bis-butyltin dimethoxide, dimethyl-bis[1-oxonedecyl)oxy]stannane, di-n-octyltin bis-isooctyl mercaptoacetate; amine catalysts such as triethylenediamine, triethylamine, and tributylamine; organic acids such as oleic acid and acetic acid; delayed catalysts; and mixtures thereof. The catalyst is preferably added in an amount sufficient to catalyze the reaction of the components in the reactive mixture. In one embodiment, the catalyst is present in an amount from about 0.001 percent to about 5 percent by weight of the composition.

In accordance with this invention, ultra-high molecular weight polyethylene (UHMWPE) powder may be added to the polyurea composition to improve the impact-resistance of the resulting golf ball. By the term, "ultra-high molecular weight," as used herein, it is meant a powder having a molecular weight of at least 3,000,000 Daltons. Preferably, the polyethylene powder has a molecular weight in the range of 3,000,000 to 12,000,000 Daltons. Several factors need to be considered when adding the polyethylene powder to the polyurea composition.

As in the case of many added components, the polyethylene powder may have both a positive and negative impact on the properties of the final composition. This potential trade-off in properties makes it difficult to add the UHMWPE powder to achieve an optimum balance of properties. For example, adding a relatively low amount of the UHMWPE powder is economically advantageous, but it will not provide the composition with sufficient impact-resistance. On the other hand, adding an excessive amount may detrimentally affect the density of the composition. The UHMWPE has a density of 0.93 g/cm$^3$ and it will act as density-adjusting filler when added to the polyurea material. Normally, the polyurea material will have a density greater than the UHMWPE powder. High loadings of the relatively less dense UHMWPE powder to the polyurea material can substantially decrease the moment of inertia of the golf ball and cause it to have a drastically higher initial spin rate. As the club face strikes the ball, there is higher resistance from the ball's moment of inertia and hence the initial spin rate of the ball increases. For purposes of the present invention, the UHMWPE powder should be added to the polyurea composition in an amount in the range of about 5 to about 30 parts by weight (PBW) based on total weight of polymer. In this manner, the impact-resistance of the polyurea layer will be enhanced, while other desirable playing performance properties will be retained.

In one version, the intermediate layer contains about 70 to about 95% by weight of a polymeric matrix constituting a polyurea composition and about 30 to about 5% by weight of the UHMWPE powder based on weight of polymer matrix. In another version, the intermediate layer contains about 70 to about 95% by weight of a polymer matrix hybrid blend of polyurea and polyurethane, and about 30 to about 5% of the UHMWPE powder. The matrix hybrid blend may contain about 5 to about 95% by weight of polyurea material and about 95% to about 5% of polyurethane material as described above. In yet other versions of the intermediate layer, the polymer matrix may include other polymers in addition to the polyurea such as, for example, vinyl resins, polyesters, polyamides, and polyolefins.

In some instances, a first portion of the UHMWPE particles is embedded in the formed intermediate layer and a second portion of UHMWPE particles, projects from and is partially exposed outside of the layer. In other instances, substantially all of the UHMWPE particles are completely embedded within the layer. The resulting intermediate layer contains at least two distinct phases. There is a substantially continuous polymeric phase (matrix) comprising the polyurea composition and a substantially disperse phase of UHMWPE powder particulate. The particles are dispersed substantially throughout the polymeric phase. The UHMWPE powder particulate does not chemically react with the polyurea resin. However, a bonding force is created by the interpenetrating powder particulate in the polymer matrix of the polyurea material. The UHMWPE powder particulate maintains its own distinct phase when it is dispersed in the polyurea matrix. Moreover, the UHWPE powder has a melting point of 130° to 135° C.; however, even when it is heated to its molten state, the particles retain their morphology. The UHMWPE particles tend to resist flow in the molten state and instead exhibit elastic-like properties. The particles have an average particle size of less than about 200 microns and more preferably a particle size distribution in the range of about 10 microns to about 90 microns. If desired, the polyethylene particulate may be surface-treated by chemical or mechanical means, for example, silane surface-treatment or corona discharge so that the particulate may be more effectively dispersed in the polymer matrix.

Figure 5:
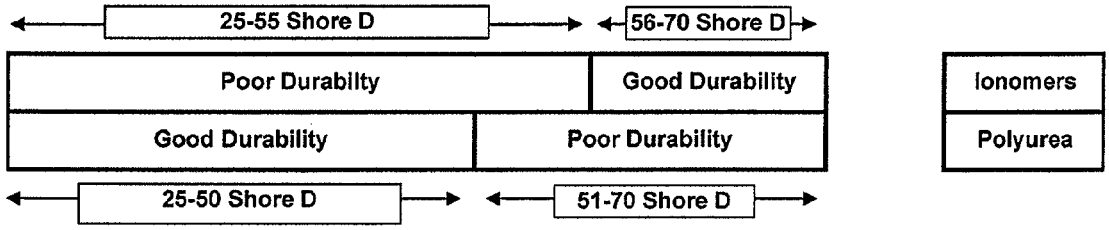
FIG. 5 is a graph showing a comparison of hardness and durability properties between intermediate layers made with ionomer resins and intermediate layers made with polyurea resins (that do not contain UHMWPE powder).

Referring to the Graph in FIG. 5, a comparison of hardness and durability properties between intermediate layers made with ionomer resins versus intermediate layers made with polyurea resins (that do not contain UHMWPE powder) is shown. It has been found that traditional polyurea casing layers (that do not contain UHMWPE powder) having a hardness level in the range of about 25 to about 50 Shore D and generally show good durability (impact-resistance). However, when the casing layer hardness is increased to a level above 50 Shore D, the durability of polyurea casing layers tends to drop off and such casing layers show insufficient impact-resistance. Thus, when the objective is to make a casing layer having a hardness level within a range of about 56 to about 70 Shore D, ionomer casing layers are traditionally favored over polyurea casing layers. The test methods for measuring the material hardness of the polyurea and ionomer resins are described in further detail below.

In accordance with the present invention, the durability of intermediate layers made with polyurea compositions may be improved significantly when UHMWPE powder is added to the composition. Particularly, the durability of polyurea casing layers having a hardness level in the range of about 51 to about 70 Shore D may be improved when UHMWPE powder is added. Surprisingly, the durability of the polyurea casing layer may be improved so that it is comparable to the durability of ionomer casing layers. This would make employing polyurea casing layers in the construction of golf balls much more desirable. The polyurea casing layer would have sufficient durability (impact-resistance) at high hardness levels, particularly in the range of about 51 to about 70 Shore D and more particularly in the range of about 56 to about 70 Shore D.

In the present invention, filler materials, in addition to the UHWPE powder particulate, may be added to the polyurea compositions to modify certain properties. These additional materials include, but are not limited to, catalysts, wetting agents, coloring agents, optical brighteners, cross-linking agents, whitening agents such as titanium dioxide and zinc oxide, ultraviolet (UV) light absorbers, hindered amine light stabilizers, defoaming agents, processing aids, surfactants, and other conventional additives. Antioxidants, stabilizers, softening agents, plasticizers, including internal and external plasticizers, foaming agents, and compatibilizers may also be added to the composition of the invention in amounts known in the art. Density-adjusting fillers also can be added to modify the modulus, tensile strength, and other properties of the compositions. The density-adjusting fillers are generally inorganic, and suitable fillers include numerous ceramics, glass spheres (hollow or filled), metals, metal oxides and salts, such as zinc oxide and tin oxide, barium sulfate, zinc sulfate, calcium carbonate, zinc carbonate, barium carbonate, clay, tungsten, tungsten carbide, silicas, regrind (recycled rubber core material), and mixtures thereof. Generally, the additives will be present in the polyurea composition in an amount between about 1 and about 70 weight percent based on the total weight of the composition depending upon the desired properties.

Golf Ball Construction

Golf balls made in accordance with this invention can be of any size, although the United States Golf Association (USGA) requires that golf ball used in competition have a diameter of at least 1.68 inches. For play outside of USGA competition, the golf balls can have smaller diameters. Preferably, the diameter of the golf ball is in the range of about 1.68 to about 1.80 inches. The core will generally have a diameter in the range of about 1.26 inches to about 1.60 inches. The range of thicknesses for the intermediate layer(s) may vary. In general, the thickness of the intermediate layers will be about 0.120 inches or less. Particularly, in one preferred embodiment, the intermediate layer has a thickness in the range of about 0.015 to about 0.120 inches and more preferably about 0.020 to about 0.060 inches. Preferably, the overall diameter of the core and intermediate layers is about 90 percent to about 98 percent of the overall diameter of the finished ball. The thickness of the cover may vary, but it is generally in the range of about 0.020 inches to about 0.090 inches and preferably about 0.050 inches or less.

The layers comprising the multi-layered golf ball may have different hardness values. That is, there may be hardness gradients across different layers of the ball. For example, the hardness of the core layer will vary, but it is generally in the range of about 30 to about 65 Shore D and more preferably in the range of about 35 to about 60 Shore D. The intermediate layer(s) of the present invention may also vary in hardness. In general, the hardness of the intermediate layer is about 30 to about 75 Shore D and more preferably about 55 to about 65 Shore D. Like the core and intermediate layers, the hardness of the cover may vary depending upon the construction and desired properties of the ball. The hardness of the cover layer is generally in the range of about 30 to about 65 Shore D. As discussed above, one advantageous feature of this invention is the intermediate casing layer hardness may be increased to a level above 50 Shore D without sacrificing durability. The durability of polyurea casing layers having a hardness level in the range of about 51 to about 70 Shore D surprisingly may be improved when UHMWPE powder is added.

The relative hardness levels of the core layer, intermediate layer(s), and cover layer are primary factors in determining distance performance and spin rate of the ball. As a general rule, when the ball has a relatively soft cover, the initial spin rate of the ball is relatively high and when the ball has a relatively hard cover, the initial spin rate of the ball is relatively low. Furthermore, in general, when the ball contains a relatively soft core, the resulting spin rate of the ball is relatively low. The compressive force acting on the ball is less when the cover is compressed by the club face against a relatively soft core. The club face is not able to fully interface with the ball and thus the initial spin rate on the ball is lower. On the other hand, when the ball contains a relatively hard core, the resulting spin rate of the ball is relatively high. The club face is able to more fully interface with the ball and thus the initial spin rate of the ball is higher.

In some instances, the intermediate layer(s) may be designed to be the hardest part of the ball. For example, the core may have a hardness in the range of about 40 to about 55 Shore D; the intermediate layer may have a hardness in the range of about 60 to about 75 Shore D; and the cover layer may have a hardness in the range of about 25 to about 55 Shore D. In other instances, the outer layer is intended to be hardest portion of the ball. For example, the core may have a hardness in the range of about 40 to about 55 Shore D; the intermediate layer may have a hardness in the range of about 55 to about 65 Shore D; and the cover layer may have a hardness greater than 70 Shore D. In yet other instances, the inner core is formulated to be the hardest point. For example, the core may have a hardness greater than 60 Shore D, while the intermediate layer may have a hardness in the range of about 50 to about 55 Shore D; and the cover layer may have a hardness in the range of about 25 to about 45 Shore D. The compression values of the golf ball may vary but are generally in the range of about 40 to about 120, preferably about 60 to about 100, and more preferably about 80 to about 95.

The golf balls of this invention may be constructed using any suitable technique known in the art. These methods generally include compression molding, flip molding, injection molding, retractable pin injection molding (RPIM)), reaction injection molding (RIM), liquid injection molding (LIM), casting, vacuum forming, flow coating, spin coating, dipping, spraying, and the like. More particularly, a compression or injection molding process can be used to form the solid spheres that will be used as the core. The casing layer composition may be pre-formed into semi-cured shells. Specifically, a quantity of the casing layer material is placed into a compression mold and molded under sufficient pressure, temperature and time to produce semi-cured, semi-rigid half-shells. The half-shells are then place around the core (or ball sub-assembly) and cured in a second compression mold to reach the desirable size. In yet another method, the solid composition of the casing layer is dispersed in a non-aqueous solvent system, and the dispersion is sprayed on the cores and dried. The outer cover layer may be applied by any suitable technique injection molding, compression molding, casting, reaction injection molding (RIM), vacuum forming, and the like. Normally, compression and injection molding techniques are used to make thermoplastic cover materials, while RIM, liquid injection molding, and casting are used to make thermoset cover materials.

Test Methods

Hardness: The surface hardness of a golf ball layer or other spherical surface is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements and is set to take hardness readings at 1 second after the maximum reading is obtained. The digital durometer must be attached to and its foot made parallel to the base of an automatic stand. The weight on the durometer and attack rate conforms to ASTM D-2240.

It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness, as measured directly on a golf ball (or other spherical surface), typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

It should be understood that the multi-layered golf balls having an intermediate layer containing UHMWPE powder described and illustrated herein represent only presently preferred embodiments of the invention. It is appreciated by those skilled in the art that various changes can be made without departing from the spirit and scope of this invention. It is intended that all such embodiments be covered by the appended claims.

We claim:

1. A golf ball, comprising: a core; an outer cover material; and an intermediate layer disposed between the core and outer cover material, the intermediate layer comprising a polyurea composition containing ultra-high molecular weight polyethylene powder particulate dispersed therein, wherein the ultra-high molecular weight polyethylene powder is present in the amount of about 5 to about 30 percent by weight.

2. The golf ball of claim 1, wherein the ultra-high molecular weight polyethylene powder is present in the amount of about 10 to about 20 percent by weight.

3. The golf ball of claim 1, wherein the core comprises polybutadiene.

4. The golf ball of claim 1, wherein the core is a one-piece core.

5. The golf ball of claim 1, wherein the polyurea intermediate layer further comprises pigments and fillers.

6. The golf ball of claim 1, wherein the cover material comprises a polyurea composition.

7. The golf ball of claim 1, wherein the core has a hardness in the range of about 30 to about 65 Shore D.

8. The golf ball of claim 1, wherein the core has a diameter of about 1.26 to about 1.60 inches.

9. The golf ball of claim 1, wherein the cover has a hardness in the range of about 30 to about 65 Shore D.

10. The golf ball of claim 1, wherein the cover has a thickness of about 0.020 inches to about 0.090 inches.

11. The golf ball of claim 1, wherein the intermediate layer has a thickness of about 0.015 to about 0.120 inches.

12. The golf ball of claim 11, wherein the intermediate layer has a thickness of about 0.020 to about 0.060 inches.

* * * * *